US006401956B1

(12) United States Patent
Heinicke et al.

(10) Patent No.: US 6,401,956 B1
(45) Date of Patent: Jun. 11, 2002

(54) SAFETY CONTAINER END HAVING IMPROVED OPENING CHARACTERISTICS

(75) Inventors: Paul R. Heinicke, Canton; William A. Kirk, Massillon, both of OH (US)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

(21) Appl. No.: 09/400,032

(22) Filed: Sep. 21, 1999

(51) Int. Cl.[7] ..... B65D 17/34
(52) U.S. Cl. ..... 220/270; 220/273; 220/276
(58) Field of Search ..... 220/270, 272, 220/273, 276

(56) References Cited

U.S. PATENT DOCUMENTS

| | | | | |
|---|---|---|---|---|
| 3,838,788 A | | 10/1974 | Stargell | |
| 3,891,117 A | | 6/1975 | Dragomier et al. | |
| 3,939,787 A | | 2/1976 | Morrison | 113/121 |
| 3,941,277 A | | 3/1976 | McKinney et al. | |
| 3,945,334 A | | 3/1976 | Ostrem et al. | 113/121 |
| 3,980,201 A | | 9/1976 | Keiji | 220/270 |
| 3,986,632 A | | 10/1976 | Morrison et al. | 220/273 |
| 3,993,010 A | | 11/1976 | Taniuchi | 113/121 |
| 3,996,867 A | | 12/1976 | Taniuchi | 113/1 F |
| 4,017,000 A | * | 4/1977 | Woodley | 220/270 |
| 4,052,949 A | | 10/1977 | Woodley | 113/121 |
| 4,299,329 A | | 11/1981 | Keiji | 220/276 |
| 4,397,402 A | | 8/1983 | Keiji | 220/268 |
| 4,419,241 A | | 12/1983 | Hoffmann | 210/493.5 |
| 4,565,298 A | | 1/1986 | Taniuchi | 220/273 |
| 4,759,464 A | | 7/1988 | Taniuchi | 220/273 |
| 4,804,106 A | | 2/1989 | Saunders | 220/273 |
| 4,816,068 A | | 3/1989 | Douchy et al. | 75/53 |
| 4,906,292 A | | 3/1990 | Douchy et al. | 75/53 |
| 4,974,914 A | | 12/1990 | Jenkins | 312/214 |
| 5,038,956 A | * | 8/1991 | Saunders | 220/270 X |
| 5,069,356 A | | 12/1991 | Zysset | 220/276 |
| 5,105,977 A | | 4/1992 | Taniuchi | 220/712 |
| 5,174,706 A | | 12/1992 | Taniuchi | 413/17 |
| 5,217,134 A | * | 6/1993 | Saunders | 220/270 X |
| 5,348,809 A | | 9/1994 | Oyagu et al. | 428/622 |

FOREIGN PATENT DOCUMENTS

| | | |
|---|---|---|
| EP | 0 024 093 A1 | 1/1979 |
| WO | WO 80/01558 | 8/1980 |
| WO | WO 80/02133 | 10/1980 |
| WO | WO 87/01359 | 3/1987 |
| WO | WO 87/01628 | 3/1987 |

OTHER PUBLICATIONS

Photomicrographs of safety type container ends (87 sheets).

* cited by examiner

*Primary Examiner*—Gary E. Elkins
*Assistant Examiner*—Robin Hylton
(74) *Attorney, Agent, or Firm*—Woodcock Washburn LLP

(57) ABSTRACT

An easy open safety end having a central portion and a rim portion separated by a score line. A tab applies a force to the end adjacent the score line so as to shear the score line at opening. A circumferentially extending fold is formed in either the central portion or the rim portion, or both, to protect the user from being cut by the sharp edge the results upon shearing the score line. A first circumferential portion of the fold is tight, whereas a second portion, which is preferably proximate the tab is loose. The fold is displaced below a portion of the end adjacent the score line by a circumferentially extending gap. In the tight portion of the fold, the width of the gap is less than the thickness of the end, and preferably less than one half the thickness, whereas in the loose portion of the fold, the width of the gap is greater than the thickness of the end, and is preferably at least twice the thickness of the end.

40 Claims, 7 Drawing Sheets

SAFETY CONTAINER END HAVING IMPROVED OPENING CHARACTERISTICS

FIELD OF THE INVENTION

The current invention is directed to a safe ended type end for a container. More specifically, the current invention is directed to an end for a container having improved opening characteristics.

BACKGROUND OF THE INVENTION

Many products, such as food stuffs, including potato chips, as well as other articles, such as tennis balls, are packaged in containers having an easy open end 2, such as that shown in FIGS. 1–3. Conventionally, such ends are formed from metal plate, such as aluminum, having a thickness t of about 0.0095 inch (0.24 mm). Such ends have a circular score line formed between the central panel 8 and the rim 10. The rim 10 has a curl 17 formed thereon for attachment to the side wall of the container. A tab 4, attached by a rivet 5 to the central panel 8, is employed to effect opening. By pulling up on the end 7 of the tab 4, the nose 6 of the tab presses against the rim and causes the score line 12 to shear, thereby separating the central panel 8, which is discarded, from the rim 10. The minimum pulling force exerted on end of the tab 4 that is required to cause the initial shearing of the score line 12 is referred to as the "pop value." After initial shearing, continued manipulation of the tab allows the user to completely sever the central panel from the rim portion by shearing the score line along its entire circumference. The force necessary to continue the shearing of the score line after the initial severing is referred to as the tear force. The lower the pop value and the tear force, the easier it is for the user to open the container.

The opening operation described above can result in a sharp edge being formed on the rim 8, which can result in a cutting hazard to the user. This rim edge can be made safe by folding under a portion of the rim 10 adjacent the score line 12 inwardly and then outwardly so as to form an upper fold 16 and a lower fold 14, with the bend 18 of the lower fold projecting radially inward beyond the score line 12 so as to protect the user from the sharp edge formed on the rim when it is severed along the score line, as shown in FIGS. 1–3.

The opening process also results in a sharp edge on the central panel. This central panel edge can be made safe by folding under a portion of the cental panel adjacent the score line 112 outwardly and then inwardly so as to form an upper fold 121 and a lower fold 117, with the bend of the lower fold projecting radially outward beyond the score line 112 so as to protect the user from the sharp edge formed on the central panel when it is severed along the score line, as shown in FIG. 4. In this type of can end, folds 115 and 123 are also formed in the rim portion 110, as discussed above. However, in this case, the rim folds are located above the score line, rather than below it. A can end having a folds in both the rim and the central panel is more fully disclosed in U.S. Pat. No. 3,986,632 (Morrison et al.), hereby incorporated by reference in its entirety.

Conventionally, the folds are tightly formed. For example, an easy open end made by the assignee of the current invention is made from metal plate having a thickness t of about 0.0095 inch (0.24 mm). As shown in FIG. 3, the vertical gap $G_1$, by which the upper surface of the bend 18 of the lower fold 14 is displaced below the lower surface of the rim 10, has a width $W_1$ in the vicinity of the score line 12 that is typically less than the thickness t of the plate and may often be less than one-half the thickness t of the plate and is sometimes even zero, so that the upper surface of the bend 18 contacts the lower surface of the rim portion 20. The width $W_2$ of the vertical gap $G_2$, by which the lower surface of the bend 19 in the upper fold 16 is displaced above the upper surface of the lower portion of the rim 10, is typically approximately equal to one or two times the thickness t of the plate. The overall width $W_0$ of the folds 14 and 16 is typically no more than about six times the thickness t of the plate.

Unfortunately, the tightness of the folds can undesirably increase the difficulty of initially shearing the score line 12—that is, increase the pop value. As shown in FIG. 3 the width $W_1$ of the gap $G_1$ is minimal. Consequently, in order for the nose 6 of the tab 4 to create sufficient downward deflection in the upper portion 20 of the rim 10 to shear the score line 12, it must apply sufficient force F to also downwardly deflect the underlying bend 18 in the lower fold 14. This situation, which is sometimes referred to as "lockout", increases the pop value.

The tightness of the folds can also increase the tear force, especially in ends that have folds on both the central panel and the rim panel. In such ends, further manipulation of the tab 5 and tearing of the score around its circumference after the initial pop causes the central panel 8 to bend along line A—A shown in FIG. 1. As shown in FIG. 4, this deformation causes the periphery of the central panel to locally bow at locations B, which are typically at approximately the 10:30 o'clock and 1:30 o'clock locations. This bowing causes the severed edge 109 of the central panel 108 to contact the bend in the rim fold 115 above it so that additional force must be applied to the tab 104 in order to effect continued shearing of the score line 112, thereby increasing the required tearing force.

Although easy open ends can be made, and have been made, with uniformly large gaps around the entire circumference of the fold, such as that disclosed in U.S. Pat. No. 5,105,977 (Taniuchi), such an arrangement can compromise the safety afforded by the fold if the upper portion 20 of the rim 10 does not spring completely down against the underlying fold after the central panel 8 has been removed.

Consequently, it would be desirable to create a easy open container end that is safe and yet is also easy to open.

SUMMARY OF THE INVENTION

It is an object of the current invention to provide an easy open safety container end with improved opening characteristics. This and other objects is accomplished in an easy open safety container end comprising (i) a central portion, (ii) a rim portion surrounding the central portion, the rim and central portions having a thickness and separated by a score line, (iii) means for applying a force to a portion of the end proximate the score line, and (iv) first and second circumferentially extending folds formed in the end adjacent the score line. The first fold is displaced from a portion of the end proximate the score line by a circumferentially extending gap, with a first circumferentially extending portion of the gap being less than the thickness and a second circumferentially extending portion of the gap being greater than the thickness. In a preferred embodiment of the invention, the second portion of the gap is greater than twice the thickness and encompasses an angle between about 2° and 45°. The first portion of the gap is less than one half the thickness.

The current invention also encompasses an apparatus for forming an easy open container end, comprising upper and lower forming tools having opposing forming surfaces for forming a circumferentially extending fold in the container end, a first recess formed in at least one of the opposing forming surfaces, at least one of the forming tools movable toward the other of the forming tools whereby the-recessed portion of the forming surface forms a first circumferentially extending portion of the fold and the remaining portion of the forming surface forms a second circumferentially extending portion of the fold, the first portion of the fold being looser than the second portion of the fold.

DESCRIPTION OF THE PREFERRED EMBODIMENT

Figure 1:
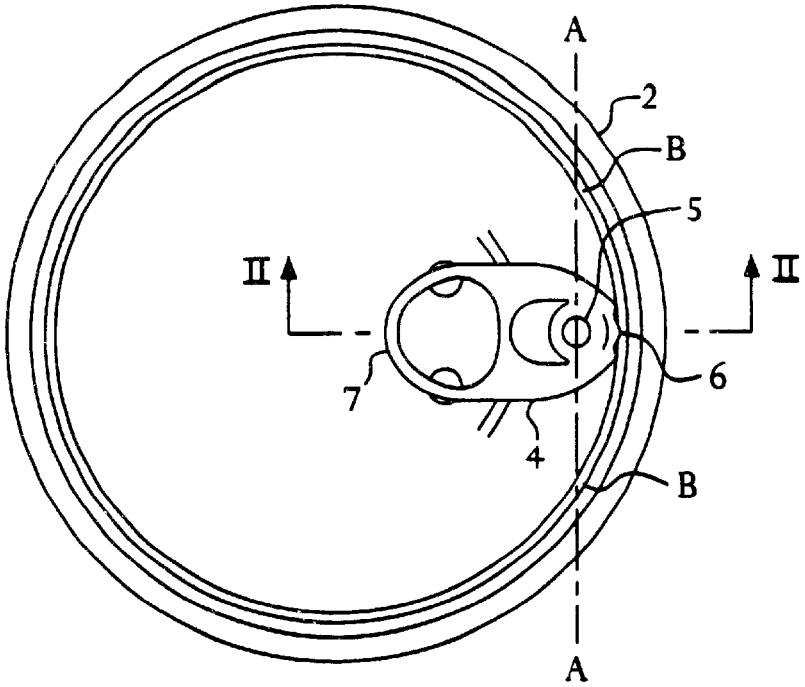
FIG. 1 (PRIOR ART)
FIG. 1 is a plan view of an easy open container end according to the prior art.
Figure 2:
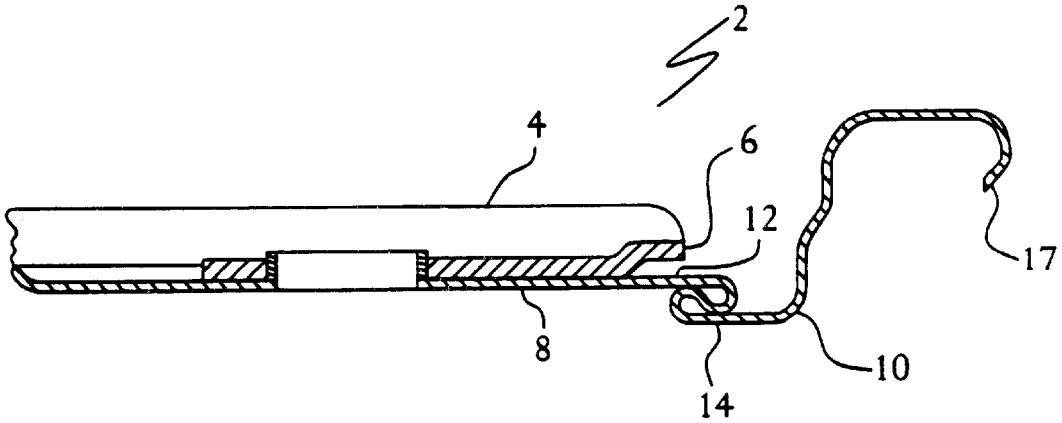
FIG. 2 (PRIOR ART)
FIG. 2 is a cross-section taken through line II—II shown in FIG. 1.
Figure 3:
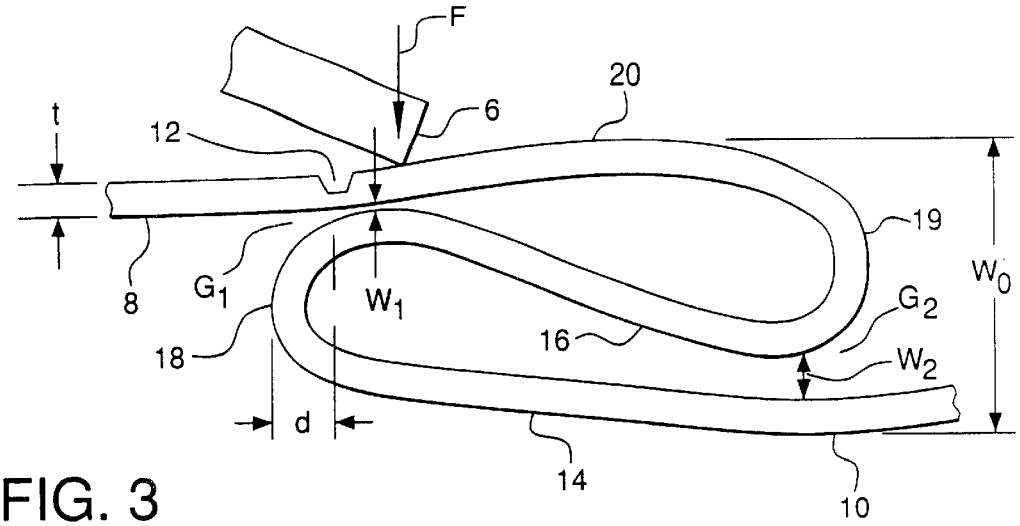
FIG. 3 (PRIOR ART)
FIG. 3 is an enlarged view of the fold area of the container end shown in FIG. 2.
Figure 5:
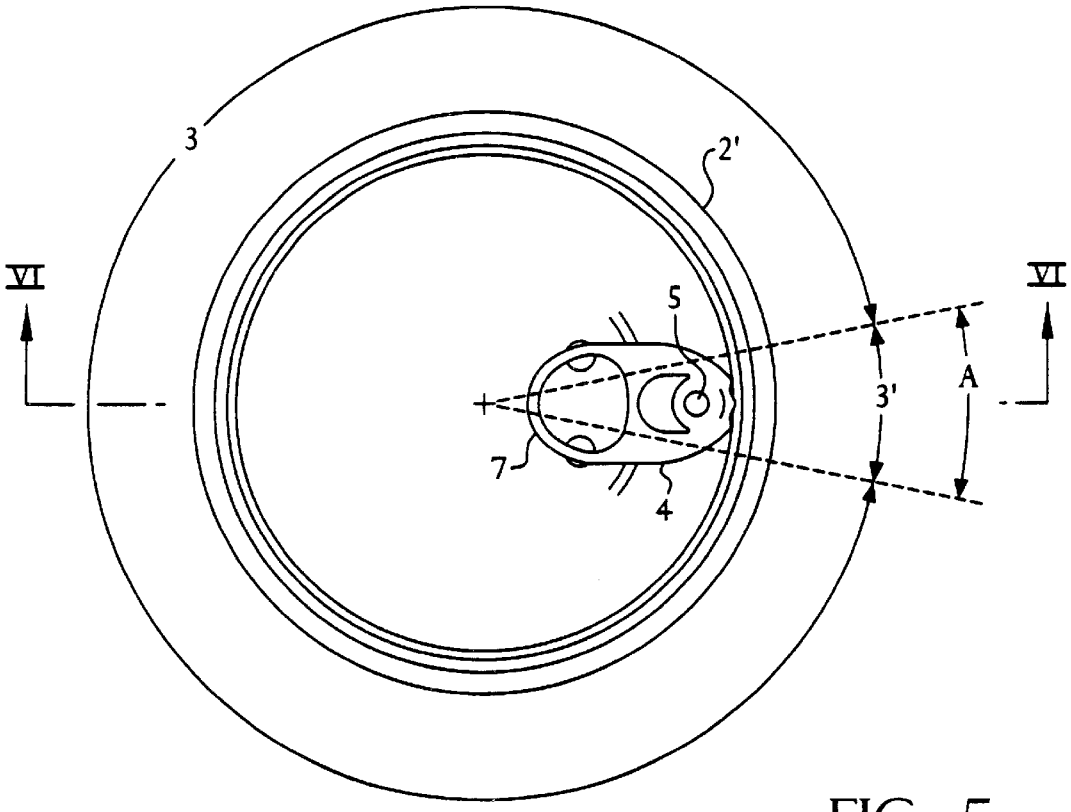
FIG. 5 is a plan view of an easy open container end according to the current invention.
Figure 6:
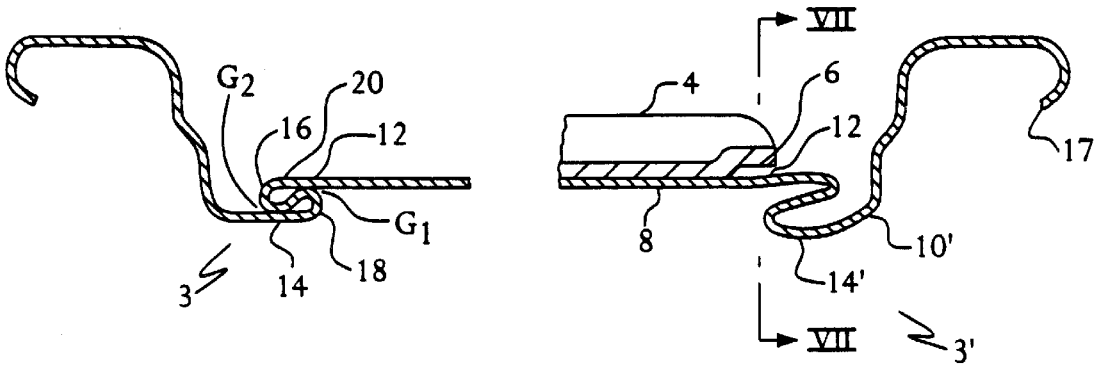
FIG. 6 is a cross-section taken through line VI—VI shown in FIG. 5.
Figure 7:
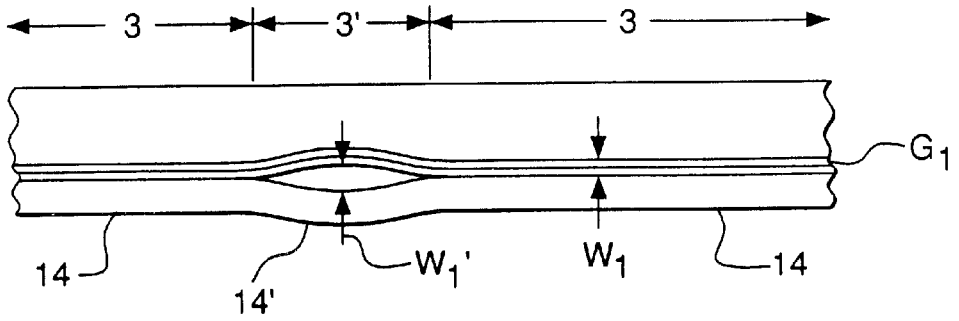
FIG. 7 is a cross-section taken through line VII—VII shown in FIG. 6.

A container end 2' having folds on only the rim portion 10' according to the current invention is shown in FIGS. 5–8. As is conventional, the end 2' is made from aluminum plate having a thickness t of about 0.0095 inch (0.24 mm). As shown in FIGS. 5 and 6, around a portion 3 of its circumference, the geometry of the upper fold 16 is the same as that in conventional safety ends, shown in FIGS. 1–3. In particular, the upper fold 16 in circumferential portion 3 is tight, for example as shown in FIG. 3 or the left hand side of FIG. 6, so that the vertical gap $G_1$, by which the upper surface of the bend 18 of the lower fold 14 is displaced below the lower surface of the rim 10', has a width $W_1$ in the vicinity of the score line 12 that is preferably less than the thickness t of the plate (i.e., less than about 0.01 inch (0.25 mm)), more preferably less than about one-half the thickness t of the plate (i.e., less than about 0.005 inch (0.12 mm)), and most preferably is zero so that the upper surface of the bend 18 contacts the lower surface of the rim portion 20. Moreover, as also shown in FIG. 3 and the left hand portion of FIG. 6, in the circumferential portion 3, the lower fold 14 is also tight, so that the vertical gap $G_2$, by which the lower surface of the bend 19 in the upper fold 16 is displaces above the upper surface of the lower portion of the rim 10', has a maximum width $W_2$ that is preferably no more than about two times the thickness t of the plate (i.e., no more than about 0.02 inch (0.5 mm)). In addition, the overall $W_0$ width of the fold 14 is typically no more than about six times the thickness t of the plate (i.e., no more than about 0.06 inch (1.4 mm)).

However, according to the current invention, a circumferential portion of the folds are locally loosened. Specifically, the upper fold 16 in the portion 3' of the circumference of the container end 2', which may be in the vicinity of the tab nose 6, is loose rather than tight. As shown best in FIGS. 7 and 8, in the loose portion 16' of the upper fold, the width $W_1'$ of the vertical gap $G_1'$ adjacent the score line 12 is greater than the thickness t of the plate (i.e., greater than about 0.01 inch (0.25 mm)) and, more preferably, is at least twice the thickness of the plate (i.e., at least about 0.02 inch (0.5 mm)). Moreover, preferably the lower fold 14' is also loose in portion 3' so that, preferably, the width $W_2'$ of the vertical gap $G_2'$ is more than two times the thickness t of the plate (i.e., more than about 0.02 inch (0.5 mm)) and, more preferably, is at least three times the thickness of the plate (i.e., at last about 0.03 inch (0.75 mm)). The overall height H' of the loose fold portion 3' is preferably more than about six times the thickness t of the plate (i.e., more than about 0.06 inch (1.4 mm)) and, most preferably, is at least seven times the thickness of the plate (i.e., more than about 0.07 inch (1.8 mm)).

Figure 8:
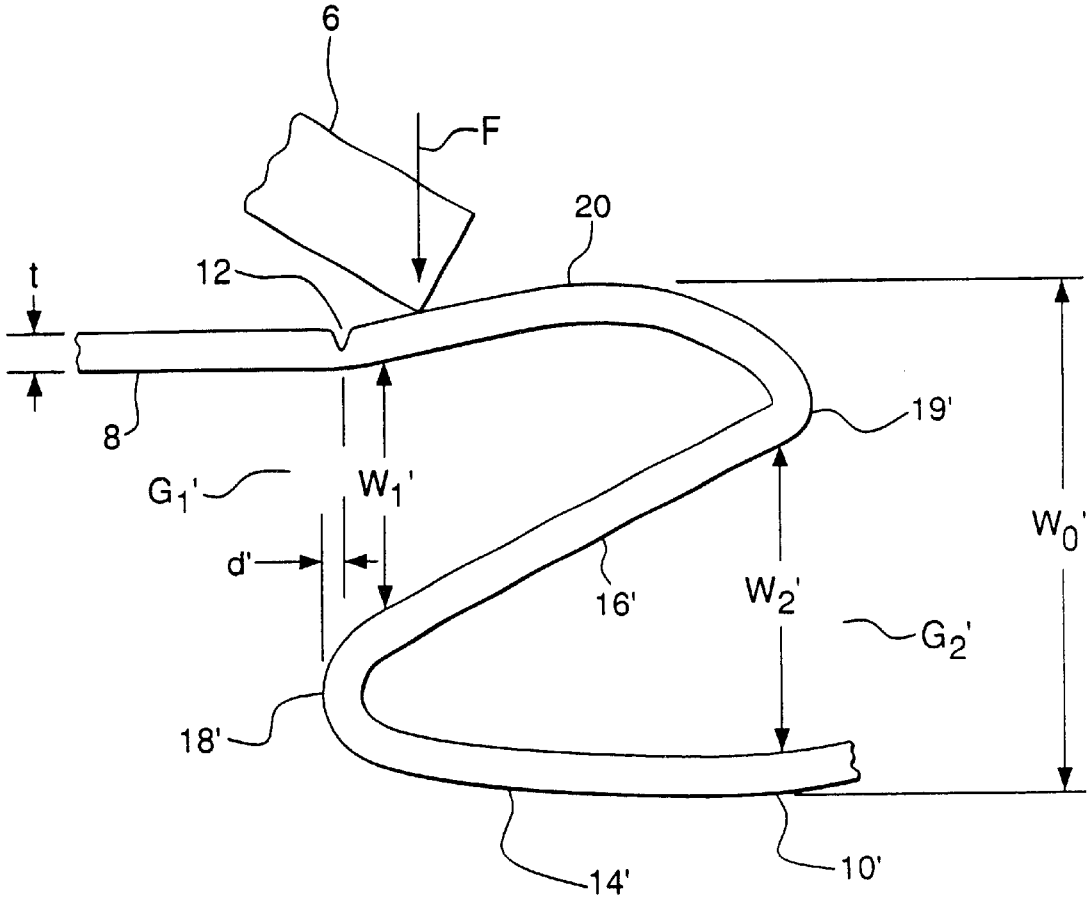
FIG. 8 is enlarged view of a portion of loose fold area of the container end shown in FIG. 6.

As shown best in FIG. 8, as a result of the local looseness of the folds in circumferential portion 3', the deflection of the portion 20 of the rim 10' as a result of the force F applied by the nose 6 of the tab 4 when the tab is pulled is unimpeded by the bend 18' in the lower fold 14', thereby minimizing the force required to shear the score line 12. Further, as shown in FIGS. 3 and 8, loosening the folds locally tends to reduce the distance d by which the bend 18 in the lower fold 14 projects radially inward past the score line, thereby reducing the likelihood that the bend will interfere with the opening process in the loose fold area.

As shown in FIG. 5, the tight fold circumferential portion 3 of the container end 2' forms a major portion of the circumference in order to provide maximum safety from sharp edges, while the loose fold circumferential portion 3' forms a minor portion of the circumference. Preferably, the loose fold portion is formed in only those areas of the circumference in which tight folds interfere with the opening process, such as the lock out areas previously discussed. Most preferably, the minor, loose fold portion is located in the vicinity of the nose 6 of the tab 4. In order to prevent lockout and minimize the pop value, yet retain as much as possible the optimal safety afforded by a tight fold, the loose fold portion 3' preferably extends over an arc centered about the axis of the tab and defined by any angle A that is between about 1° and 25°, more preferably between about 2° and 10°. In one embodiment of the invention, a loose fold portion centered about the tab has a circumferential length of about ¼ inch (6 mm). However, a smaller or larger portion 3' could also be utilized, if desired, in order to obtain an optimum balance of ease of opening and safety. Moreover, although as shown in FIG. 5, the container end 2' has only one portion 3' having loose folds, it may also be desirable in some instances to distribute several sections of loose folds around the circumference of the end 2' in order to obtain optimal ease of opening.

Although as shown in FIGS. 5–8 locally loose folds are formed in both the upper and lower rim folds, if desired, the invention could be practiced by forming locally loose areas in only one of the folds.

A series of experiments were conducted on container ends made from aluminum plate having a thickness of about 0.0095 inch (0.24 mm) to determine the effect of loosening the fold 14' on the pop value. Twenty six conventional container ends 2 were made having tight folds 14 and 16 and the pop value necessary to shear the score line 12 was measured, resulting in an average pop value of 4.0 lbs. The experiment was repeated with twenty six container ends 2' made according to the current invention with loose folds 14' and 16' extending over a portion 3' of the circumference defined by an angle of about 3° to 5° centered about the axis of the tab 4. The average pop value of these ends was 2.5 lbs, a reduction of almost 40%.

Container ends 2' according to the current invention are preferably made on a conventional multi-station rotary press. The tooling for forming the folds in such container ends 2' is shown in FIGS. 9–12. The partially formed end 9, in which pre-folds 32 have been formed in a prior station, is transferred to a folding station 41. The upper tooling of the folding station 41 comprises a locator ring 42 that encircles a fold punch 40. The lower tooling of the folding station 41 comprises a lower forming die 44 that encircles a fold ring 46, which is supported on a spring (not shown). The fold ring 46 encircles a pressure pad 52.

Figure 10:
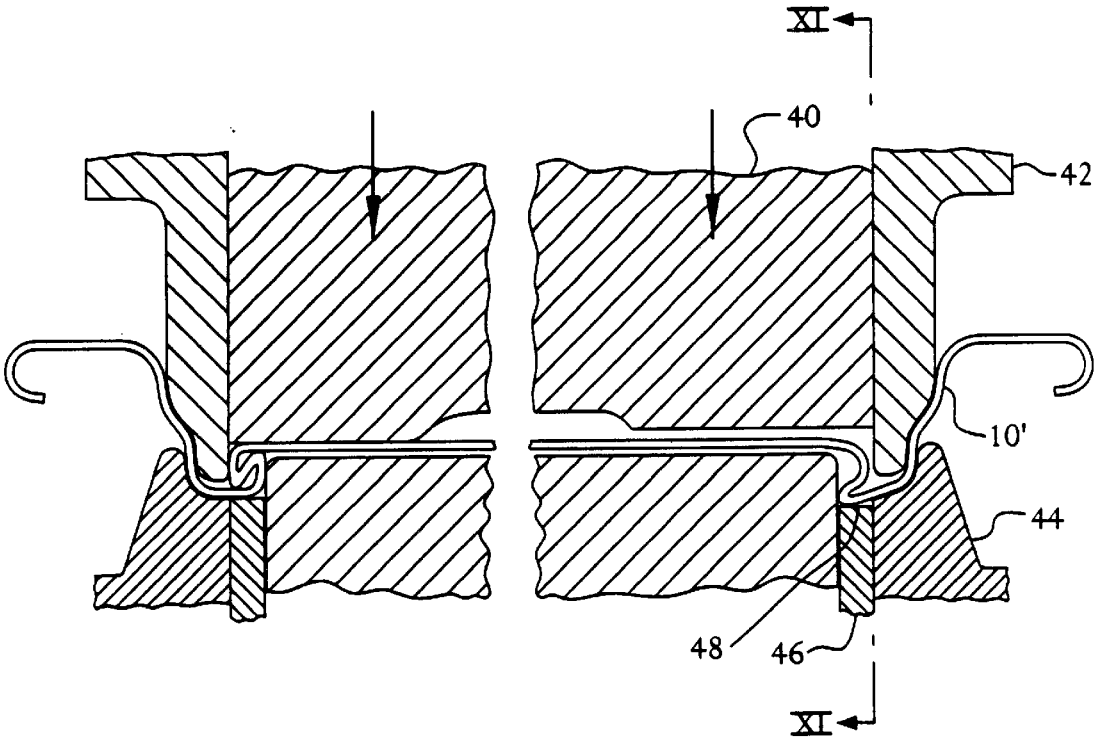
Figure 11:
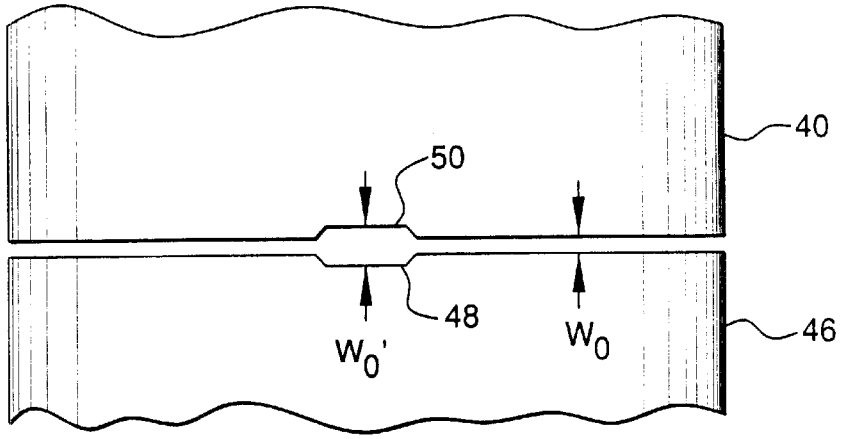
FIG. 11 is a elevation view of the tooling shown in FIG. 10 taken along line XI—XI.
Figure 12:
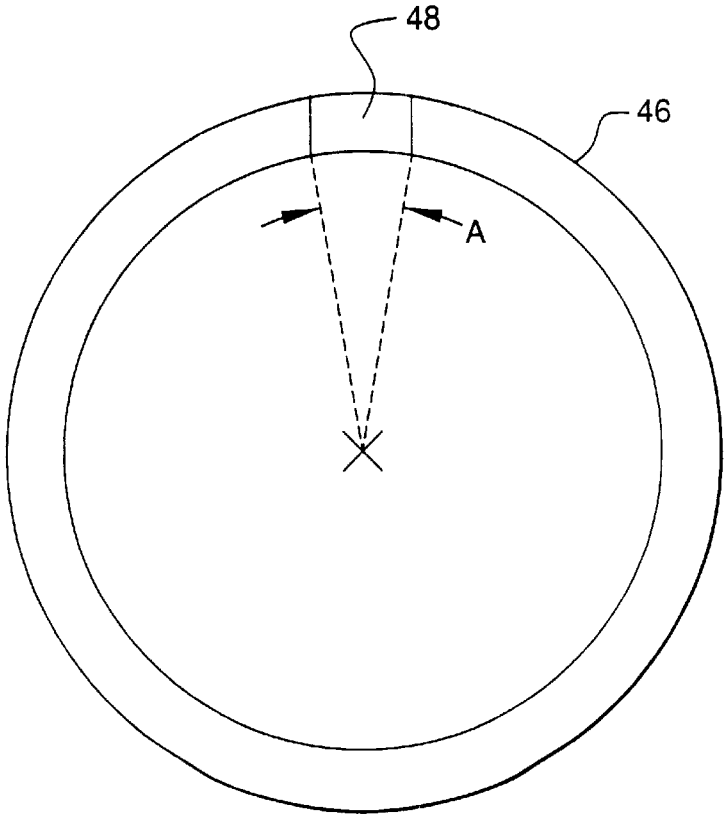
FIG. 12 is a plan view of the fold ring shown in FIGS. 9–11.

As shown best in FIGS. 11 and 12, a relief 48 is formed in the fold ring 46 over the portion of its circumference encompassed by the angle A that is intended to form the loose folds. A similar relief 50 is formed in the fold punch 40. Preferably, the depth of the reliefs 48 and 50 are such that when the fold punch 40 and fold ring 46 reached the closed position, shown in FIG. 10, the overall width of the gap formed between the relieved portions is approximately equal to $W_0'$, the intended overall width of the loose folds, whereas the overall width of the gap formed in the remainder of the circumference is approximately equal to $W_0$, the intended overall width of tight folds.

During manufacture, the locator ring 42 accurately locates the partially formed end 9 on the tooling. The fold punch 40 is then lowered, thereby compressing the pre-folds 32 so as to form the final folds. In the portion of the circumference of the tooling that is not relieved, the resulting folds are tight, as shown in FIG. 3. However, the portion formed by the relieved portions 48 and 50, the folds are loose, as shown in FIG. 8.

Figure 13:
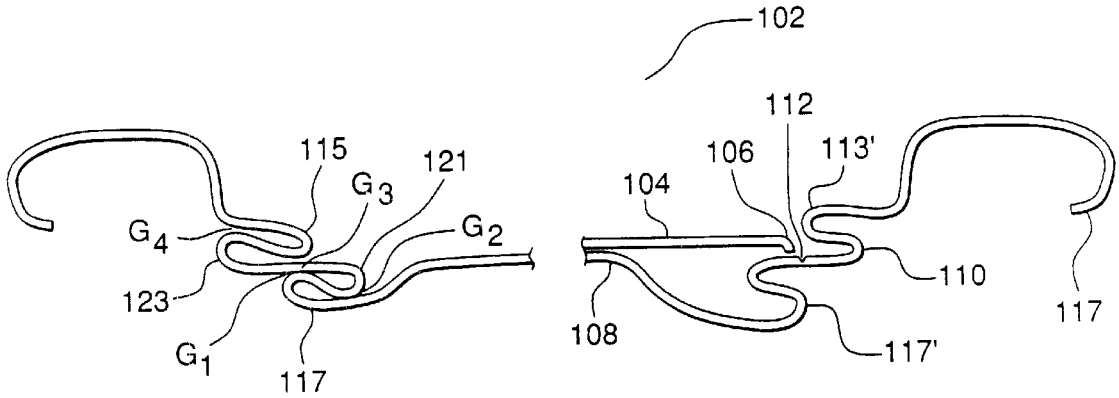
FIG. 13 is a cross-section similar to that shown in FIG. 6 showing the invention incorporated into an end having folds on both the central portion and the rim portion.
Figure 14:
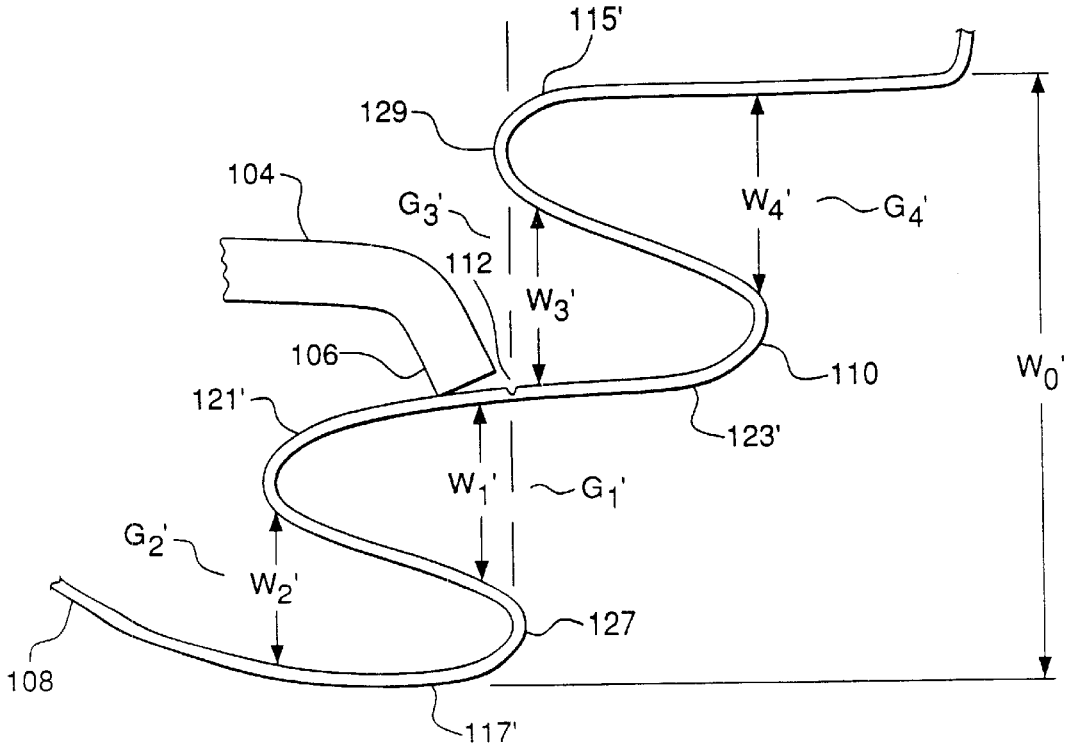
FIG. 14 is enlarged view of a portion of the loose fold area of the container end shown in FIG. 13.

The invention can also be practiced on an easy open end having folds on both the rim portion and the central panel. FIGS. 13 and 14 show the invention as applied to a container end 102 have both safety folds formed on the central panel 108 and the rim portion 110. In this case, the folds 117 and 121 located below the score line 112 are formed on the central panel 108, while the folds 115 and 123 on the rim portion 110 are located above the score line. The nose 106 of the tab 104 presses on the portion of the central panel 110 proximate the score line 112 in order to effect opening.

According to the current invention, the central panel folds 117 and 121 around a first portion of the circumference are tight, as shown in the lefthand portion of FIG. 13. In the tight fold portion, the vertical gap $G_1$, by which the upper surface of the bend 127 of the lower fold 117 is displaced below the lower surface of the upper portion of the central panel 108, has a width in the vicinity of the score line 112 that is preferably less than the thickness t of the plate (i.e., less than about 0.01 inch (0.24 mm)), more preferably less than about one-half the thickness t of the plate (i.e., less than about 0.005 inch (0.12 mm)), and most preferably is zero. Further, in the tight fold portion, the vertical gap $G_2$, by which the lower surface of the bend in the upper fold 121 is displaced above the upper surface of the lower portion of the central panel, has a maximum width $W_2'$ that is preferably no more than about two times the thickness t of the plate (i.e., no more than about 0.02 inch (0.5 mm)).

The central panel folds 117' and 121' around another portion of the circumference are loose. Specifically, the width $W_1'$ of the vertical gap $G_1'$ adjacent the score line 12 is greater than the thickness t of the plate (i.e., greater than about 0.01 inch (0.24 mm)) and, more preferably, is at least twice the thickness of the plate (i.e., at least about 0.02 inch (0.5 mm)). Moreover, in the loose fold circumferential portion, preferably, the width $W_2'$ of the vertical gap $G_2'$ is more than two times the thickness t of the plate (i.e., more than about 0.02 inch (0.5 mm)) and, more preferably, is at least three times the thickness of the plate (i.e., at least about 0.03 inch (0.75 mm)).

Similarly, the rim folds 115 and 123 around the portion of the circumference in which the central panel folds are tight are also tight, as shown in the left hand portion of FIG. 13, with the vertical gap $G_3$, by which the lower surface of the bend 129 of the upper rim fold 115 is displaced above the upper surface of the lower portion of the rim 110, having a width in the vicinity of the score line 112 that is preferably less than the thickness t of the plate (i.e., less than about 0.01 inch (0.24 mm)), more preferably less than about one-half the thickness t of the plate (i.e., less than about 0.005 inch (0.12 mm)), and most preferably is zero, and the vertical gap $G_4$, by which the lower surface of the upper portion of the rim is displaced above the upper surface of the bend in the lower rim fold 123, having a maximum width that is preferably no more than about two times the thickness t of the plate (i.e., no more than about 0.02 inch (0.5 mm)).

The rim folds 115' and 123' around the circumferential portion in which the central panel folds are loose are also loose. Specifically, the width $W_3'$ of the vertical gap $G_3'$ adjacent the score line 12 is greater than the thickness t of the plate (i.e., greater than about 0.01 inch (0.24 mm)) and, more preferably, is at least twice the thickness of the plate (i.e., at least about 0.02 inch (0.5 mm)). Moreover, in this portion, preferably, the width $W_4'$ of the vertical gap $G_4'$ is more than two times the thickness t of the plate (i.e., more than about 0.02 inch (0.5 mm)) and, more preferably, is at least three times the thickness of the plate (i.e., less than about 0.03 inch (0.75 mm)).

As shown best in FIG. 14, as a result of the looseness of the portion 121' of the fold in the central panel 108, the deflection of the portion of the central panel adjacent the score line 112 as a result of the force applied by the nose 106 of the tab 104 when the tab is pulled is unimpeded by the bend 127 in the lower fold 117', thereby minimizing the force required to shear the score line 112. Further, as a result of the looseness of the portion 123' of the fold in the rim portion 110, bowing of the central panel adjacent the score line during tearing, as previously discussed, will not cause interference with the bend 129 in the upper rim fold 115', thereby minimizing the force required to tear the score line 112. Further still, loosening the folds tends to reduce the distance by which the bend 127 in the lower central panel fold 117 projects radially outward past the score line and tends to reduce the distance by which the bend 129 in the upper rim fold 115 projects radially inward past the score line, thereby reducing the likelihood that these bends will interfere with the opening process.

Figure 4:
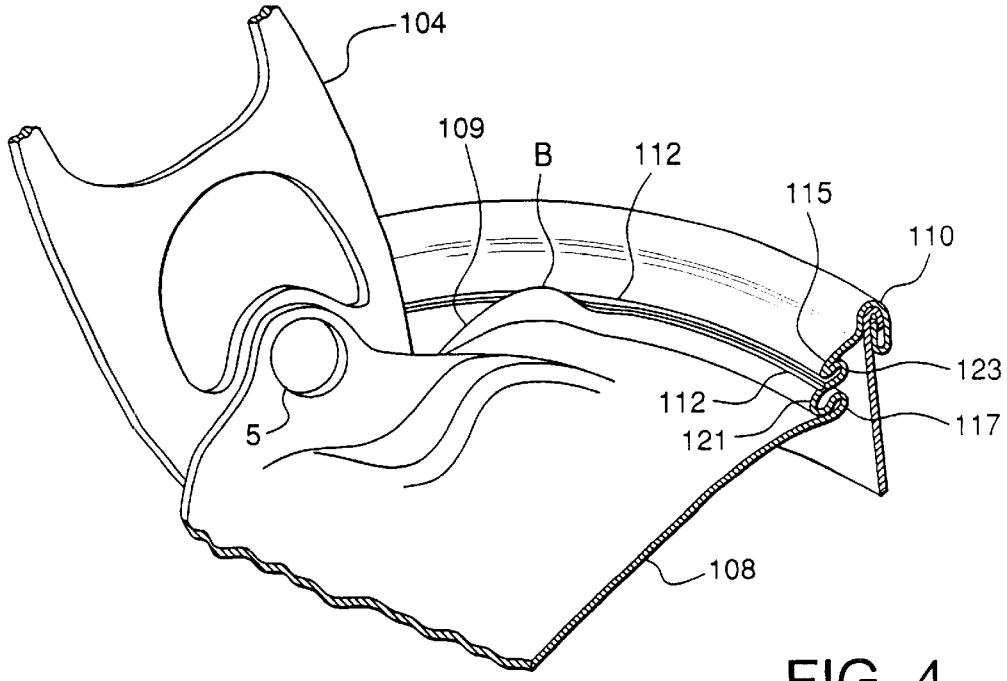
FIG. 4 (PRIOR ART)
FIG. 4 is an isometric view of a portion of a prior end can end having folds on both the central and rim portion during the opening process.

The tight fold circumferential portion of the end shown in FIGS. 13 and 14 forms a major portion of the circumference in order to maximize protection from sharp edges, while the loose fold portion forms a minor portion of the circumference. Preferably, the minor, loose fold portion is formed in only those areas of the circumference in which tight folds interfere with the opening process, such as the lock out areas previously discussed. Most preferably, the loose fold portion is comprised of three portions. The first loose fold portion is in the vicinity of the nose 106 of the tab 104—that is at the 12o'clock location. The second and third loose fold portions are formed on either side of the nose, preferably at about the 10:30 and 1:30 o'clock positions corresponding to locations B in FIGS. 1 and 4 where the lock out situation previously discussed occurs. In order to prevent lockout and minimize the pop and tear values, yet retain as much as possible the optimal safety afforded by a tight fold, the loose fold portion at 12 o'clock preferably extends over an arc centered about the axis of the tab and defined by any angle A that is between about 1° and 25°, more preferably between about 2° and 10°. The loose fold portions at 10:30 and 1:30 o'clock preferably each extend over an arc defined by any angle A that is between about 3° and 75°, more preferably between about 6° and 30°. Thus, in total, the loose fold portions at 10:30, 12 and 1:30 o'clock encompass an arc of about 7° to 175°, more preferably about 14° to 70°. In one embodiment of the invention, the circumferential length of the loose fold portion at 12 o'clock is about ¼ inch (6 mm) and the circumferential length of the loose fold portions at 10:30 and 1:30 o'clock are each about ¾ inch (20 mm). However, smaller or larger loose fold portions 3', or a greater number of loose fold portions, could also be utilized, if desired, in order to obtain an optimum balance of ease of opening and safety.

Figure 9:
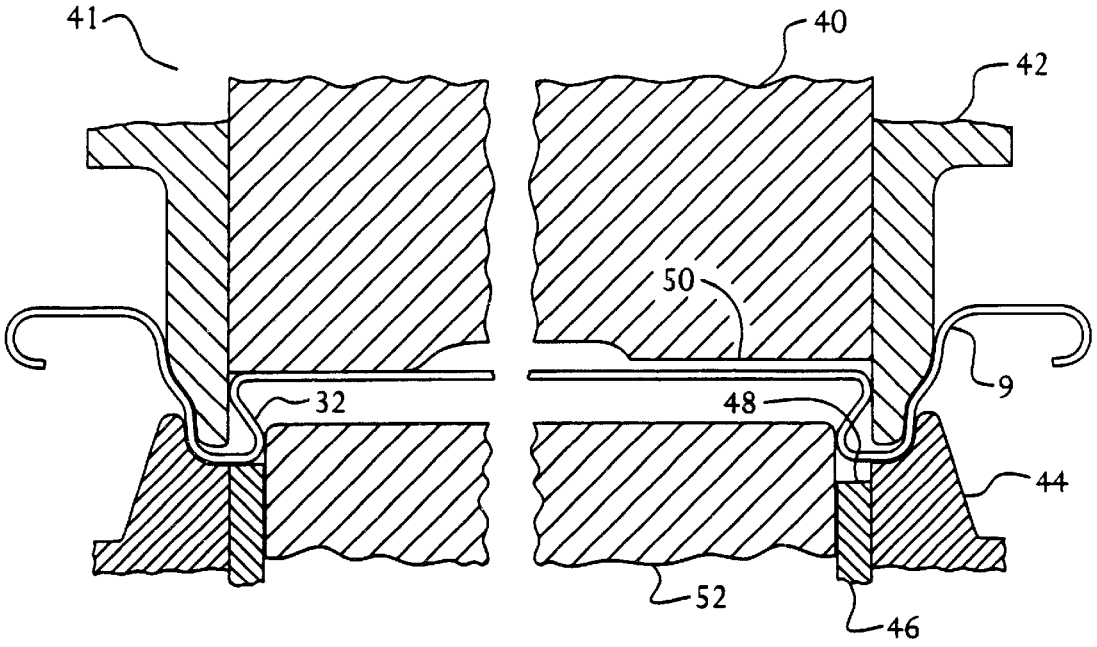
FIGS. 9 and 10 show two positions of the tooling used to produce the container end shown in FIGS. 5–8.

Although as shown in FIGS. 9 and 10, locally loose folds are formed in both the rim portion and the central panel, if desired, the locally loose folds could be formed in only the rim portion or in only the central panel, leaving the entirety of the folds in the other portion of the end tight.

The present invention may be embodied in other specific forms without departing from the spirit or essential attributes thereof and, accordingly, reference should be made to the appended claims, rather than to the foregoing specification, as indicating the scope of the invention.

What is claimed:

1. An easy open safety container end having improved opening characteristics comprising:

a) a central portion;

b) a rim portion surrounding said central portion, said rim and central portions having a thickness and separated by a score line;

c) means for applying a force for shearing said score line;

d) first and second circumferentially extending folds formed in at least one of said central portion and said rim portion at a location proximate said score line, said first fold displaced from a surface of said one of said central portion and said rim portion in which said folds are formed that is adjacent said score line so as to form a circumferentially extending gap therebetween, said gap having a width, said width of said gap over a first portion of said circumference of said gap being less than said thickness, said width of said zap over at least second and third portions of said circumference of said gap being greater than said thickness, said second and third portions of said circumference of said gap being distinct from each other and circumferentially displaced away from said force applying means on opposing sides thereof, whereby said width of said gap varies around said circumference of said gap so as to be increased over at least two distinct portions thereof.

2. The easy open end according to claim 1, wherein said first portion of said circumference of said gap forms a major portion of the total circumference of said gap and said second and third portions of said circumference of said gap form a minor portion of the total circumference of said gap.

3. The easy open end according to claim 2, wherein said width over said first portion of said circumference of said gap is less than about 0.005 inch, and wherein said width of said second and third portions of said circumference of said gap is at least about 0.02 inch.

4. The easy open end according to claim 2, wherein said thickness is about 0.01 inch.

5. The easy open end according to claim 2, wherein said width over said second and third portions of said circumference of said gap is at least twice said thickness.

6. The easy open end according to claim 5, wherein said width over said first portion of said circumference of said gap is less than one half said thickness.

7. The easy open end according to claim 6, wherein said width over said first portion of said circumference of said gap is approximately zero.

8. The easy open end according to claim 5, wherein said fourth portion of said circumference of said gap encompasses an angle between about 1° and 25°.

9. The easy open end according to claim 8, wherein said fourth portion of said circumference of said gap encompasses an angle between about 2° and 10°.

10. The easy open end according to claim 5, wherein said width over a fourth portion of said circumference of said gap is greater than said thickness, said fourth portion of said circumference of said gap being disposed below said force applying means and between said second and third portions of said circumference of said gap.

11. The easy open end according to claim 1, wherein said fourth portion of said circumference of said gap encompasses an angle between about 1° and 25°.

12. The easy open end according to claim 1, wherein said fourth portion of said circumference of said gap encompasses an angle between about 2° and 10°.

13. The easy open end according to claim 1, wherein width over said first portion of said circumference of said gap is less than one half said thickness.

14. The easy open end according to claim 1, wherein said width of a fourth portion of said circumference of said gap is greater than said thickness, said fourth portion of said circumference of said gap being disposed below said force applying means and between said second and third portions of said circumference of said gap.

15. The easy open end according to claim 14, wherein said second, third and fourth portions of said circumference of said gap encompass a total angle between about 7° to 175°.

16. The easy open end according to claim 15, wherein said second, third and fourth portions of said circumference of said gap encompass a total angle between about 14° to 70°.

17. The easy open end according to claim 1, wherein said first fold and said gap are formed in said rim portion.

18. The easy open end according to claim 1, wherein said first fold and said gap are formed in said central portion.

19. The easy open end according to claim 1, wherein said gap formed between said first fold and said surface adjacent said score line is a first gap, and further comprising third and fourth circumferentially extending folds formed in the other of said central portion and said rim portion adjacent said score line on the opposite side of said score line from said first and second folds, said third fold displaced from said score line so as to form a second circumferentially extending gap therebetween, said width of said second gap over a first portion of said circumference of said second gap being less than said thickness, said width of said second gap over a second portion of said circumference being greater than said thickness, whereby said width of said second gap varies around said circumference thereof.

20. The easy open end according to claim 19, wherein said first and second folds and said first gap are formed in said rim portion and said second and third folds and said second gap are formed in said central portion.

21. An easy open safety container end having improved opening characteristics comprising:

a) a central portion;

b) a rim portion surrounding said central portion, said rim and central portions separated by a score line;

c) means for applying a force for shearing said score line;

d) first and second circumferentially extending folds formed in at least one of said central portion and said rim portion at a location proximate said score line, said first fold displaced from a surface of said one of said central portion and said rim portion in which said folds are formed adjacent said score line so as to form a circumferentially extending gap therebetween, a first portion of said circumference of said gap extending over a major portion thereof and a second portion of said circumference of said gap each having a width that is less than 0.01 inch, third and fourth portions of said circumference of said gap extending over a minor portion thereof and each having a width that is at least 0.02 inch, whereby said width of said gap varies around said circumference thereof, said third and fourth portions of said circumference of said gap being circumferentially displaced away from said force applying means on opposing side thereof, said second portion of said circumference of said gap being disposed between said third and fourth portions.

22. The easy open end according to claim 21, wherein said width over said first portion of said circumference of said gap is less than 0.005 inch.

23. The easy open end according to claim 21, wherein said third and fourth portions of said circumference of said gap each encompasses an angle between about 3° and 75°.

24. The easy open end according to claim 1, wherein said gap formed between said first fold and said surface adjacent said score line is a first gap, said second fold being displaced from said first fold by a second circumferentially extending gap, said second gap having a width, said width of said second gap over a first portion of said circumference of said second gap being less than said thickness, said width of said second gap over second and third portions of said circumference of said second gap being greater than said thickness, whereby said width of said second gap varies around said circumference thereof, said second and third portions of said circumference of said second gap being circumferentially aligned with said second and third portions of said first gap.

25. The easy open end according to claim 24, wherein said width of said second gap over said second and third portions is at least twice said thickness.

26. The easy open end according to claim 24, wherein said width of said second gap over said second and third portions is at least three time said thickness.

27. The easy open end according to claim 1, wherein said first and second folds are formed in said rim portion, and wherein a bend is formed between said first and second folds, said bend projecting radially inward beyond said score line at said second and third portions of said circumference so as to protect a user from a sharp edge formed on said rim portion when said score line is sheared.

28. The easy open end according to claim 1, wherein said first and second folds are formed in said central portion, and wherein a bend is formed between said first and second folds, said bend projecting radially outward beyond said score line at said second and third portions of said circumference so as to protect a user from a sharp edge formed on said central portion when said score line is sheared.

29. The easy open end according to claim 21, wherein said width of a fifth portion of said circumference of said gap is at least 0.02 inch, said fifth portion of said circumference of said gap being disposed below said force applying means and between said third and fourth portions of said circumference of said gap.

30. The easy open end according to claim 21, wherein said first and second folds are formed in said rim portion, and wherein a bend is formed between said first and second folds, said bend projecting radially inward beyond said score line at said third and fourth portions of said circumference so as to protect a user from a sharp edge formed on said rim portion when said score line is sheared.

31. The easy open end according to claim 21, wherein said first and second folds are formed in said central portion, and wherein a bend is formed between said first and second folds, said bend projecting radially outward beyond said score line at said third and fourth portions of said circumference so as to protect a user from a sharp edge formed on said central portion when said score line is sheared.

32. The easy open end according to claim 21, wherein said gap formed between said first fold and said surface adjacent said score line is a first gap, said second fold being displaced from said first fold by a second circumferentially extending gap, said second gap having a width, said width of said second gap over a first portion of said circumference of said second gap being less than said thickness, said width of said second gap over second and third portions of said circumference of said second gap being greater than said thickness, whereby said width of said second gap varies around said circumference thereof, said second and third portions of said circumference of said second gap being circumferentially aligned with said third and fourth portions of said first gap.

33. An easy open safety container end having improved opening characteristics comprising:

a) a central portion;

b) a rim portion surrounding said central portion, said rim and central portions having a thickness and separated by a score line;

c) means for applying a force for shearing said score line;

d) first and second circumferentially extending folds formed in at least one of said central portion and said rim portion at a location proximate said score line, said first fold displaced below a surface of said one of said central portion and said rim portion in which said folds are formed that is adjacent said score line so as to form a first circumferentially extending gap therebetween, said second fold displaced below said first fold so as to form a second circumferentially extending gap therebetween, said first and second gaps each having a width, said widths of both said first and second gaps over at least a first portion of said circumference thereof being less than said thickness, said widths of both of said first and second gaps over at least second and third portions of said circumference being greater than said thickness, said second portion of said circumference being distinct from said third portion, whereby said widths of said first and second gaps varies around said circumference so as to be increased over at least two distinct portions of said circumference.

34. The easy open end according to claim 33, wherein said widths of said first and second gaps over said second and third portions of said circumference are each at least twice said thickness.

35. The easy open end according to claim 33, wherein said first and second folds are formed in said rim portion, and wherein a bend is formed between said first and second folds, said bend projecting radially inward beyond said score line at said second and third portions of said circumference so as to protect a user from a sharp edge formed in said rim portion when said score line is sheared.

36. The easy open end according to claim 33, wherein said first and second folds are formed in said central portion, and wherein a bend is formed between said first and second folds, said bend projecting radially outward beyond said score line at said second and third portions of said circumference so as to protect a user from a sharp edge formed in said central portion when said score line is sheared.

37. The easy open end according to claim 33, wherein said widths of both of said first and second gaps over a fourth portion of said circumference being greater than said thickness, said second and third portions of said circumference being circumferentially displaced away from said force applying means on opposing side thereof, said fourth portion of said circumference being disposed proximate said force applying means.

38. The easy open end according to claim 23, wherein said third and fourth portions of said circumference of said gap each encompasses an angle between about 6° and 30°.

39. The easy open end according to claim 1, wherein said second and third portions of said circumference of said gap each encompass an angle between about 3° and 75°.

40. The easy open end according to claim 39, wherein said second and third portions of said circumference of said gap each encompass an angle between about 6° and 30°.

* * * * *

UNITED STATES PATENT AND TRADEMARK OFFICE

CERTIFICATE OF CORRECTION

PATENT NO. : 6,401,956 B1 
DATED : June 11, 2002
INVENTOR(S) : Paul R. Heinicke and William A Kirk It is certified that error appears in the above-identified patent and that said Letters Patent is hereby corrected as shown below:

Title page,
Item [57], ABSTRACT,
Line 6, delete "edge the results" and insert -- edge that results --;

Column 1,
Line 56, delete "a folds" and insert -- a fold --;

Column 2,
Line 43, delete "a easy" and insert -- an easy --;

Column 3,
Line 5, delete "the-recessed" and insert -- the recessed --;
Line 20, delete "prior end can" and insert -- prior art can --;
Line 29, delete "is enlarged" and insert -- is an enlarged --;
Line 33, delete "a elevation" and insert -- an elevation --;

Column 4,
Line 1, delete "is displaces" and insert -- is displaced --;
Line 25, delete " height H' " and insert -- width $W_0$' --;

Column 5,
Line 45, after "However," and insert -- in --;
Line 51, delete "have both" and insert -- having both --;

Column 7,
Line 59, delete "zap" and insert -- gap --;

UNITED STATES PATENT AND TRADEMARK OFFICE

CERTIFICATE OF CORRECTION

PATENT NO. : 6,401,956 B1 
DATED : June 11, 2002
INVENTOR(S) : Paul R. Heinicke and William A Kirk It is certified that error appears in the above-identified patent and that said Letters Patent is hereby corrected as shown below:

Column 8,
Line 22, delete "claim 5," and insert -- claim 10 --;
Lines 34 and 37, delete "claim 1," and insert -- claim 14, --.

Signed and Sealed this

Twenty-seventh Day of January, 2004

JON W. DUDAS
*Acting Director of the United States Patent and Trademark Office*